US007925194B2

(12) United States Patent
Han et al.

(10) Patent No.: US 7,925,194 B2
(45) Date of Patent: Apr. 12, 2011

(54) DEVELOPING UNIT AND IMAGE FORMING APPARATUS USING THE SAME

(75) Inventors: Cheol-young Han, Yongin-si (KR); Hak-kyum Kim, Seoul (KR); Hae-seog Jo, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 944 days.

(21) Appl. No.: 11/754,546

(22) Filed: May 29, 2007

(65) Prior Publication Data

US 2008/0118280 A1 May 22, 2008

(30) Foreign Application Priority Data

Nov. 22, 2006 (KR) ..... 10-2006-0116084

(51) Int. Cl.
*G03G 15/08* (2006.01)

(52) U.S. Cl. ..... 399/284

(58) Field of Classification Search ..... 399/274, 399/284

See application file for complete search history.

(56) References Cited

U.S. PATENT DOCUMENTS

| | | | | |
|---|---|---|---|---|
| 2004/0091290 | A1 * | 5/2004 | Yamada et al. | 399/284 |
| 2006/0099016 | A1 | 5/2006 | Watanabe et al. | |

FOREIGN PATENT DOCUMENTS

| | | |
|---|---|---|
| JP | 9-50183 | 2/1997 |
| JP | 10-29339 | 2/1998 |
| JP | 11-20224 | 1/1999 |
| JP | 2001-42637 | 2/2001 |
| JP | 2005-115082 | 4/2005 |
| KR | 1999-29314 | 7/1999 |
| KR | 2000-5130 | 3/2000 |
| KR | 2005-104543 A | 11/2005 |

OTHER PUBLICATIONS

Office Action issued Mar. 31, 2008, from Korean Patent Office with respect to Korean Patent Application No. 10-2006-0116084.

* cited by examiner

*Primary Examiner* — David M Gray
*Assistant Examiner* — Gregory H Curran
(74) *Attorney, Agent, or Firm* — Stanzione & Kim, LLP

(57) ABSTRACT

A developing unit to supply toner to a photosensitive medium of an image forming apparatus to form an image thereon, including a housing to hold a toner of a predetermined color, a developing roller which is coupled to the housing to be rotatable in a direction opposite to a moving direction of the photosensitive medium, to supply the photosensitive medium with the toner, and to form the image by potential difference, and a regulating blade including a coupling end part coupled to the housing and a free end part double bent with regard to the coupling end part to contact the developing roller at a tip part thereof.

22 Claims, 5 Drawing Sheets

DEVELOPING UNIT AND IMAGE FORMING APPARATUS USING THE SAME

CROSS-REFERENCE TO RELATED APPLICATIONS

This application claims priority under 35 U.S.C. §119(a) from Korean Patent Application No. 2006-0116084, filed on Nov. 22, 2006 in the Korean Intellectual Property Office, the disclosure of which is incorporated herein in its entirety by reference.

BACKGROUND OF THE INVENTION

1. Field of the Invention

The present general inventive concept relates to a developing unit to supply a toner to an electrophotographic image forming apparatus and contributes to developing an image and an image forming apparatus using the same, and more particularly to a developing unit having a regulating blade with an enhanced structure to regulate a supplied toner layer and image forming apparatus using the same.

2. Description of the Related Art

Generally, an electrophotographic image forming apparatus forms an electrostatic latent image by scanning light onto a photosensitive medium charged to a predetermined electric potential, develops the electrostatic latent image by toner of a predetermined color, transfers the developed image to a printing medium, and fixes the transferred image to produce a printed image.

The electrophotographic image forming apparatus can be divided into a wet-type and dry-type electrophotographic image forming apparatus by its toner type, and the dry-toner type image forming apparatus can be divided into a two-components developer type and a one-component developer type depending on whether a carrier is used in the developer. The two-component developer type image forming apparatus uses a two-component developer which includes a carrier and a toner mixed in a powder state, respectively. The one-component developer type image forming apparatus uses a one-component developer which includes only the toner without the carrier.

The image forming apparatus includes a photosensitive medium which forms an electrostatic latent image by being charged and exposed to light, and a developing unit which supplies the photosensitive medium with the toner to form the image.

FIG. 1 is a partial sectional view illustrating a conventional developing unit employed in the one-component developer type image forming apparatus. As illustrated in FIG. 1, the conventional developing unit includes a housing 3 filled with toner T of a predetermined color, a developing roller 5 and a supplying roller 7 both supplying a photosensitive medium 1 with the toner T, and a regulating blade 9 regulating a toner layer formed on the developing roller 5.

The supplying roller 7 contacts with the developing roller 5 and rotates in the same direction in which the developing roller 5 rotates. Therefore, the toner in the housing 3 is friction-charged at a nip which is formed between the developing roller 5 and the supplying roller 7, and is supplied to the developing roller 5 by a potential difference between bias-voltages applied to the developing roller 5 and the supplying roller 7.

The developing roller 5 is coupled to the housing 3 to be rotatable opposite to the photosensitive medium 1. The developing roller 5 supplies the photosensitive medium 1 with the toner and develops an image on an area of the electrostatic latent image, which is formed at a surface of the photosensitive medium 1, by its potential difference with the photosensitive medium 1.

The regulating blade 9 contacts with the developing roller 5 and regulates the toner layer, which is formed by the toner supplied to a surface of the developing roller 5, to have a predetermined thickness. To this end, the regulating blade 9 includes a free end part 9*a* which is bent accordingly by an external pressure, and a fixed end part 9*c* which fixes the free end part 9*a* to the housing 3.

In this case, for the toner layer to uniformly have a thickness which is about 1.5 times larger than the average diameter of a toner particle, a tip pressure which acts on a tip part 9*b* where the free end part 9*a* contacts with the developing roller 5 is required to be maintained beyond a predetermined value. On the other hand, the tip pressure is influenced by a change of a regulating angle $\theta_1$ which is defined by a surface of the free end part 9*a* and a tangent line formed by a contact between the free end part 9*a* and the developing roller 5 at the tip part 9*b*. That is, under the same conditions, the larger the regulating angle $\theta_1$ becomes, the smaller the tip pressure is required to regulate the thickness of the toner layer formed on the developing roller 5.

If the regulating angle $\theta_1$ becomes increased to lower the tip pressure, the height H of the housing 3 becomes larger. Therefore, an overall height of the developing unit may be larger if the developing unit of a structure as illustrated in FIG. 1 is provided plurally to correspond to each color and if each of the developing units is provided at a side of the photosensitive medium 1 of a drum type thus forming a color image forming apparatus of a multi-path type. Therefore, according to the above conventional developing unit, the overall height of the image forming apparatus becomes larger. Also, a diameter of the photosensitive drum should be larger if the drum type photosensitive medium 1 is employed, or otherwise a belt type photosensitive medium 1 should be employed.

On the other hand, if the regulating blade 9 is provided so that the regulating angle $\theta_1$ may be about 24° to miniaturize the overall size of the developing unit, the toner layer may have a uniform thickness when the tip pressure acting on the tip part 9*b* where the free end part 9*a* contacts with the developing roller 5 is maintained beyond a predetermined value, for example, 50 gf/cm.

However, if the tip pressure of the regulating blade is maintained beyond 50 gf/cm as described above, an excessive stress is applied to the toner. Therefore, a deterioration of the toner, such as a separation or a depression of an external additive included in the toner, may occur and the image developed on the photosensitive medium may be deteriorated. Also, the developing roller 5 may be worn by a high tip pressure thus shortening its life time.

Also, the toner layer formed on the developing roller 5 may be non-uniform if the tip pressure of the regulating blade is decreased while maintaining the regulating angle $\theta_1$ to be about 24°. Accordingly, the toner supplied to the photosensitive medium 1 may be insufficiently charged at a predetermined area, so that the toner may be developed at an unwanted position on the photosensitive medium.

SUMMARY OF THE INVENTION

The present general inventive concept provides a developing unit having a structure to form a toner layer using a relatively low tip pressure and image forming apparatus using the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a developing unit usable in an image forming apparatus, the developing unit comprising a housing to hold a toner, a developing roller disposed in the housing to supply the toner to a photosensitive body of the image forming apparatus, a supplying roller disposed in the housing to supply toner to the developing roller, and a double-bent regulating blade connected to the housing to regulate a toner layer formed on the developing roller.

The double-bent regulating blade may comprise a first bend at a position where it connects to the housing and a second bend at a position between a first part to connect to the housing and a second part to contact the developing roller.

The first bend may be in a rotation direction opposite to the second bend.

The double-bent regulating blade may comprise a coupling part to couple with the housing, and a free end part to contact the developing roller, wherein the free end part is bent and forms an angle $\theta_2$ between a first part to connect to the coupling part and a second part to contact the developing roller.

The second part may comprise a tip part disposed at an end of the second part to contact the developing roller, wherein the tip part is provided in a direction favorable to a rotational direction of the developing roller such that the tip part trails a rotation of the developing roller and regulates the toner layer formed on the developing roller.

The double-bent regulating blade can be disposed such that the coupling part is at a position higher than a center of the developing roller.

The angle $\theta_2$ may be about $40° \leqq \theta_2 \leqq 60°$.

An angle $\phi$ between a line connecting a contact point of the double-bent regulating blade and a center of the developing roller and a line connecting the center of the developing roller and a center of the supplying roller may be about $30° \leqq \phi \leqq 90°$.

A height of the housing may be about 16 mm or less.

The second bend may define an angle $\theta_3$ of less than 180°.

The double-bent regulating blade may be disposed between the developing roller and the housing, and may comprise a fixed end coupled to the housing, a tip contacting the developing roller, a first bending part extended from the tip part, and a second bending part extended and bent between the first bending part and the fixed end.

The first bending part may form an angle greater than 40° with a tangential line of the developing roller at a contact position between the tip part and the developing roller.

The second bending part may be bent from the fixed end in a first rotation direction and the first bending part may be bent from the second bending part in a second rotation direction opposite to the first bending direction.

The tip part may comprise a distal end bent from the first bending part in the first rotation direction.

The foregoing and/or other aspects and utilities of the present general inventive concept can also be achieved by providing an image forming apparatus, comprising a photosensitive medium to form an electrostatic latent image by being charged and exposed to a light, a developing unit to supply a toner to the photosensitive medium, a transfer unit to transfer the image formed on the photosensitive unit onto a printing medium, and a fixing unit to fix the image transferred onto the printing medium, wherein the developing unit comprises a housing to hold a toner, a developing roller disposed in the housing to supply the toner to a photosensitive body of the image forming apparatus, a supplying roller disposed in the housing to supply toner to the developing roller, and a double-bent regulating blade connected to the housing to regulate a toner layer formed on the developing roller.

The double-bent regulating blade may comprise a first bend at a position where it connects to the housing and a second bend at a position between a first part to connect to the housing and a second part to contact the developing roller.

The first bend may be in a rotation direction opposite to the second bend.

The double-bent regulating blade may comprise a coupling part to couple with the housing, and a free end part to contact the developing roller, wherein the free end part is bent and forms an angle $\theta_2$ between a first part to connect to the coupling part and a second part to contact the developing roller.

The second part may comprise a tip part disposed at an end of the second part to contact the developing roller, wherein the tip part is provided in a direction favorable to a rotational direction of the developing roller such that the tip part trails a rotation of the developing roller and regulates the toner layer formed on the developing roller.

The double-bent regulating blade may be disposed such that the coupling part is at a position higher than a center of the developing roller.

The angle $\theta_2$ may be about $40° \leqq \theta_2 \leqq 60°$.

An angle $\phi$ between a line connecting a contact point of the double-bent regulating blade and a center of the developing roller and a line connecting the center of the developing roller and a center of the supplying roller may be about $30° \leqq \phi \leqq 90°$.

The developing unit may comprise at least one developing unit for each predetermined color, and a height of the housing of each developing unit may be about 16 mm or less.

The second bend may define an angle $\theta_3$ of less than 180°.

The double-bent regulating blade may be disposed between the developing roller and the housing, and may comprise a fixed end coupled to the housing, a tip contacting the developing roller, a first bending part extended from the tip part, and a second bending part extended and bent between the first bending part and the fixed end.

The first bending part may form an angle greater than 40° with a tangential line of the developing roller at a contact position between the tip part and the developing roller.

The second bending part may be bent from the fixed end in a first rotation direction and the first bending part may be bent from the second bending part in a second rotation direction opposite to the first bending direction.

The tip part may comprise a distal end bent from the first bending part in the first rotation direction.

BRIEF DESCRIPTION OF THE DRAWINGS

These and/or other aspects and utilities of the present general inventive will become apparent and more readily appreciated from the following description of the embodiments, taken in conjunction with the accompanying drawings of which.

DETAILED DESCRIPTION OF THE PREFERRED EMBODIMENTS

Figure 1:
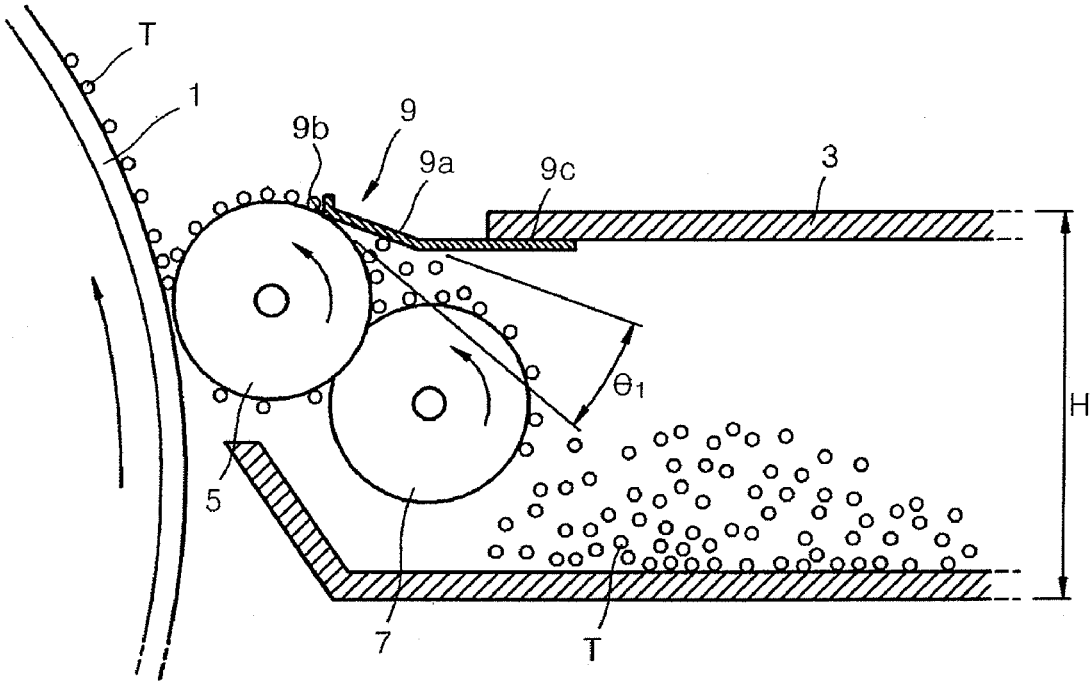
FIG. 1 (RELATED ART)
FIG. 1 is a partial sectional view illustrating a conventional developing unit employed in a one-component type image forming apparatus.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 2:
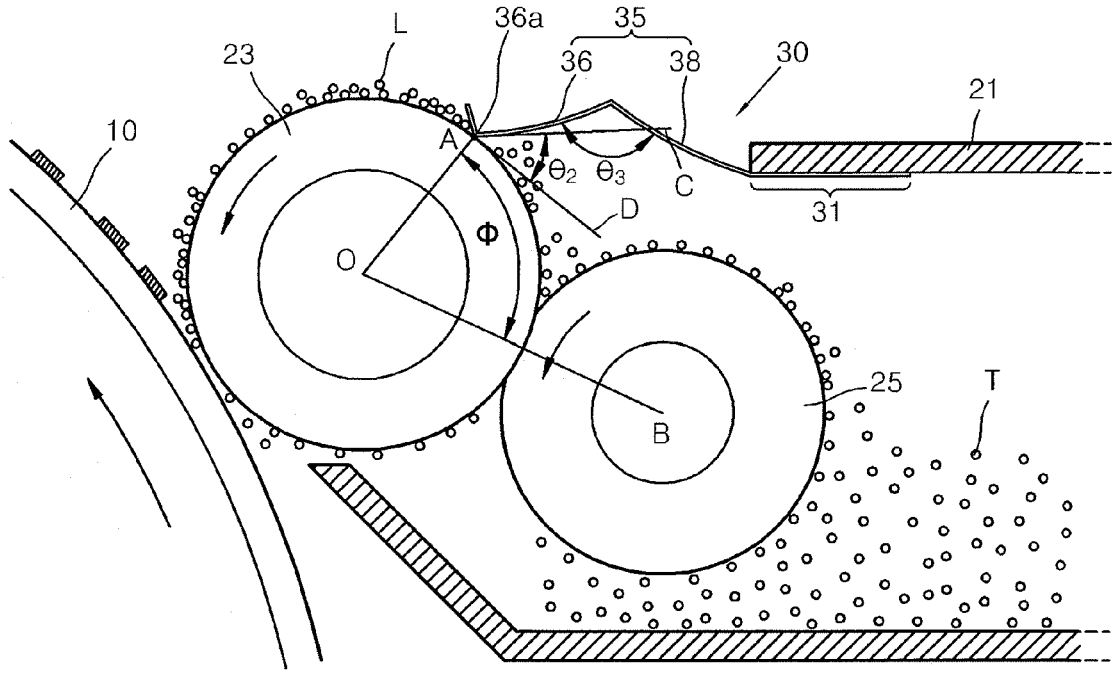
FIG. 2 is a schematic sectional view illustrating a developing unit according to an exemplary embodiment of the present general inventive concept.

FIG. 2 is a schematic sectional view illustrating a developing unit according to an exemplary embodiment of the present general inventive concept.

As illustrated in FIG. 2, a developing unit according to an exemplary embodiment of the present general inventive concept may include a housing 21 filled with a toner T of a predetermined color, a developing roller 23 coupled to the housing 21, and a regulating blade 30.

The developing roller 23 can be coupled to the housing 21 to be rotatable such that a surface of the developing roller 23 is partially exposed to an outside of the housing 21. The developing roller 23 supplies a photosensitive medium 10 with the toner T and develops an image thereon by a potential difference.

The regulating blade 30 regulates a supply amount of the toner which is supplied from the developing roller 23 to the photosensitive medium 10. Also, the regulating blade 30 prevents the toner T filled in the housing 21 from draining to the outside of the housing 21 through a part where the developing roller 23 is coupled.

To this end, the regulating blade 30 may include a coupling end part 31 coupled to the housing 21, and a free end part 35 bent twice with regard to the coupling end part 31 and having a tip part 36*a* to contact the developing roller 23. The free end part 35 is bent freely by an external pressure, and includes a first bending part 36 having the tip part 36*a* to contact the developing roller 23 and a second bending part 38 formed between the first bending part 36 and the coupling end part 31. Therefore, a regulating angle $\theta_2$ formed between the first bending part 36 and the developing roller 23 may be increased while a height of the housing 21 is decreased by double bending the first and the second bending parts 36 and 38. Accordingly, a toner layer L may be formed uniformly on the developing roller 23 while a tip pressure of the tip end part 36*a* is lowered.

Hereinafter, a disposition of the regulating blade 30 is described in detail. The coupling end part 31 can be positioned at a side higher than a center of the developing roller 23. Also, as illustrated in FIG. 2, the regulating blade 30 can be provided in a direction favorable to a rotational direction of the developing roller 23 so that the tip part 36*a* of the free end part 35 may be trailed when the developing roller 23 rotates. Therefore, the regulating blade 30 can be prevented from being turned over when the developing roller 23 is driven to rotate.

The regulating angle $\theta_2$ can satisfy a condition 1 such that the toner layer L is regulated to be uniformly formed while the tip pressure of the free end part 35 is maintained below 45 gf/cm.

$$40° \leqq \theta_2 \leqq 60° \qquad \text{<Condition 1>}$$

where the regulating angle $\theta_2$ is an angle between a bent surface C in the tip part 36*a* of the first bending part 36 and a tangent line D which is formed by the tip part 36*a* contacting with the developing roller 23 at a position A.

If the regulating angle $\theta_2$ is set to satisfy the condition 1 while a condition 2, described below, is also satisfied, a weight of the toner per unit area (M/A) may be maintained from about 0.45 to 0.7 mg/cm$^2$ where the tip pressure of the regulating blade 30 is below 40 gf/mm, and a charging amount per unit weight of the toner (Q/M) may be maintained at about −10 to −23 μC/g in a normal temperature and humidity environment.

On the other hand, if the regulating angle $\theta_2$ is below about 40°, the tip pressure can be excessively lowered and the M/A value can be increased. Therefore, a regulation of the toner layer L through the regulating blade 30 is weakened, making it difficult to uniformly form the toner layer L.

If the regulating angle $\theta_2$ is beyond about 60°, the M/A value is increased and it is may be easy to regulate the toner layer L through the regulating blade 30. However, the tip pressure of the regulating blade 30 is also increased and a problem, such as an excessive stress applied to the toner, occurs. Also, as a supplying roller 25 to be described later can be positioned lower than the developing roller 23, a problem that an overall height of the housing 21 becomes large can occur.

The first bending part 36 and the second bending part 38 may have inside surfaces facing the developing roller 23 to form an angle $\theta_3$ of less than 180°. The tip part 36*a* may include a distal end extended from the second bending part 38 in a direction opposite to the first bending part 36 with respect to a contact point between the developing roller 23 and the free end part 35. The free end part 35 is bent, that is, the second bending part 38 is bent from the coupling part 31 in a first rotation direction, the first bending part 36 is bent from the second bending part 38 in a second rotation direction, and the distal end of the tip part 36*a* can be bent from the first bent part 36 in a third rotation direction similar to the first rotation direction.

The developing unit according to the exemplary embodiment of the present general inventive concept may further include a supplying roller 25 provided in the housing 21. The supplying roller 25 rotates and supplies the developing roller 23 with the toner T. For example, the supplying roller 25 may include a sponge or other materials to attach the toner on its outer surface such that a width of its contact nip with the developing roller 23 may be enlarged when the supplying roller 25 supplies toner T to the developing roller 23 by contacting the developing roller 23 at the contact nip.

The supplying roller 25 helps a supply flow of the toner to be easily performed as well as attaches the toner T onto the developing roller 23. Accordingly, to easily perform the toner supply, a bias power source of a predetermined electric potential is applied from a power supplying device (not illustrated) to the supplying roller 25. The toner supplied by the application of the bias power source is charged to have a predetermined electric potential. Also, after developing, the supplying roller 25 can clean the toner T remaining on the developing roller 25.

To this end, a rotational direction of the supplying roller 25 and a disposition of the supplying roller 25 need to be considered in connection with the regulating blade 30.

That is, the supplying roller 25 can rotate in a same direction in which the developing roller 23 rotates, which is a counterclockwise direction in the exemplary embodiment illustrated in FIG. 2. Therefore, surfaces of the developing roller 23 and the supplying roller 25 can move in opposite directions at the contact part therebetween to effectively clean the toner remaining on the developing roller 23 after the developing roller 25 supplies the toner to the photosensitive medium 10 as well as to effectively friction charge the toner supplied from the supplying roller 25 to the developing roller 23.

Hereinafter, a disposition of the supplying roller 25 is described. If an angle $\phi$ is an angle between a line OA and a line OB, where the line OA is a line connecting a position A where the regulating blade 30 contacts with the developing roller 23 with a center O of the developing roller 23, and where the line OB is a line connecting the center O of the developing roller 23 with a center B of the supplying roller 25, the angle $\phi$ can satisfy a condition 2 described below.

$$30° \leqq \phi \leqq 90° \qquad \text{<Condition 2>}$$

If the angle $\phi$ satisfies condition 2, the tip pressure may be maintained comparably lower than about 45 gf/cm if condition 1 is also satisfied. Also, the M/A value and the Q/M value by which the thickness of the toner layer L is determined may satisfy a condition of the predetermined range described above, and the height of the housing 21 may be lowered to within about 16 mm.

The ranges of the condition 1 and 2 have been derived from a result of a test as follows.

Figure 3:
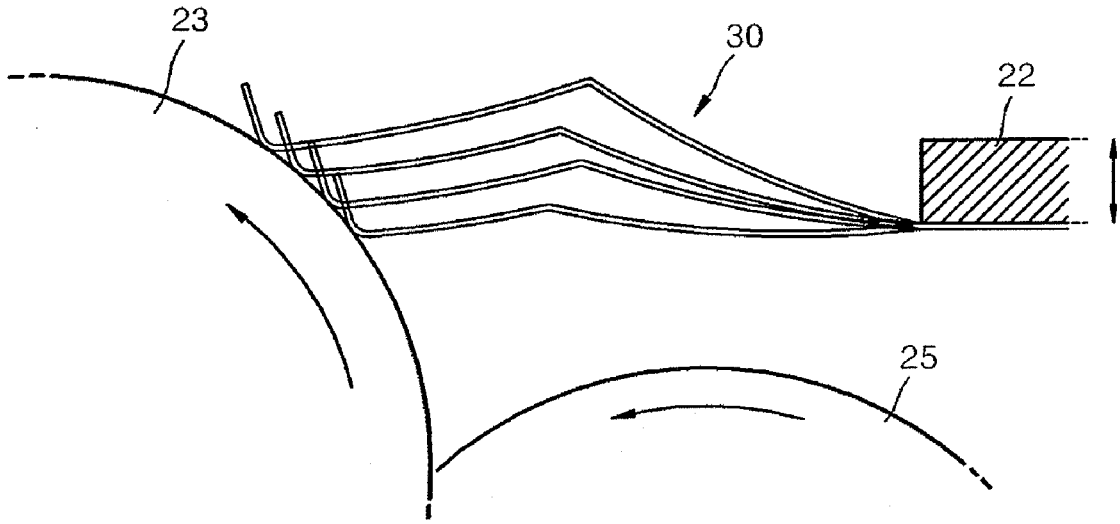
FIG. 3 is a sectional view illustrating dispositions of a regulating blade according to changes of an angle $\phi$ and a regulating angle $\theta_2$.

FIG. 3 is a sectional view illustrating dispositions of a regulating blade 30 according to changes of a regulating angle $\theta_2$ and an angle $\phi$.

Figure 4:
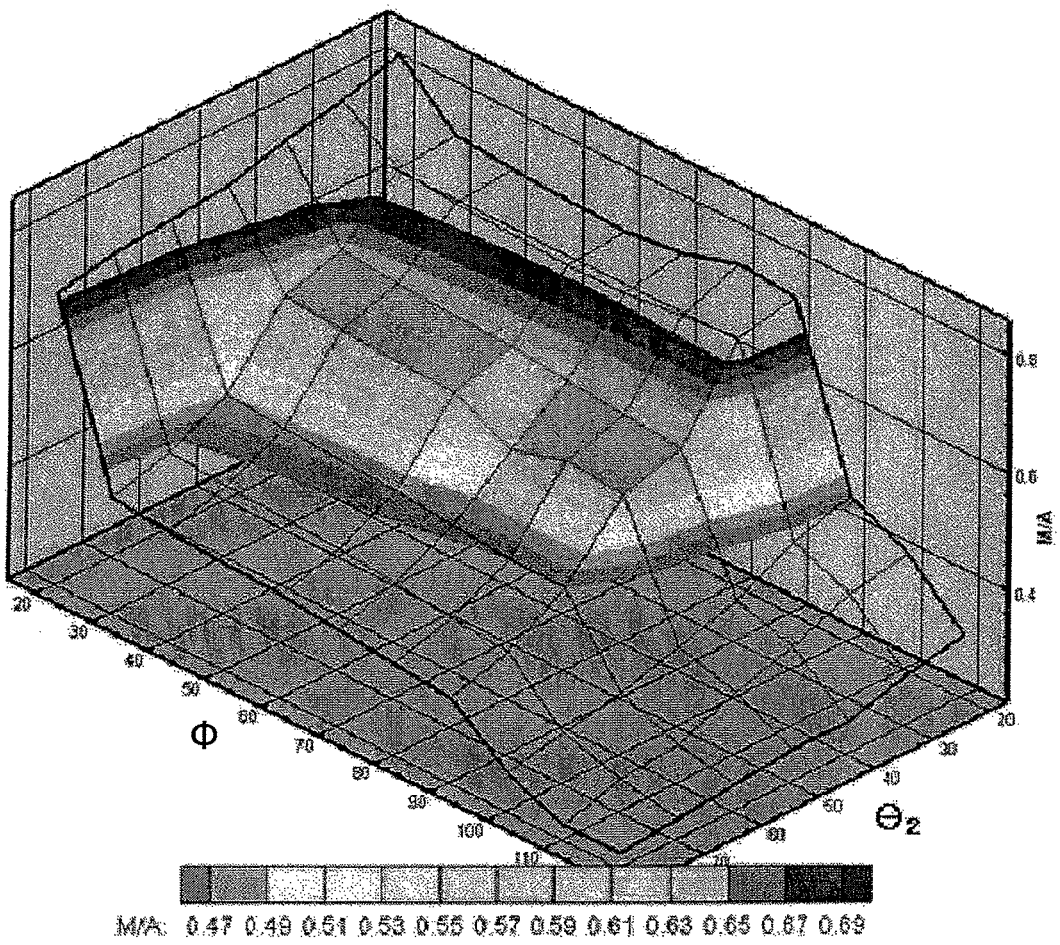
FIG. 4 is a three-dimensional graph illustrating a change of an M/A value according to changes of an angle $\phi$ and a regulating angle $\theta_2$.

FIG. 4 is a three-dimensional graph illustrating a change of an M/A value according to changes of the regulating angle $\theta_2$ and the angle $\phi$ which are measured according to a change of the disposition of the regulating blade 30 of FIG. 3.

Table 1 indicates tip pressures F, the M/A and the Q/M values which are measured when the regulating angle $\theta_2$ is changed by 10° in a range of 20° to 80° when the angle $\phi$ is also changed by 10° to 20° in a range of 20° to 100°.

The regulating blade 30 used in the above test is a stainless steel plate which has a sectional shape double bent as illustrated in FIG. 3 and has a thickness of 0.07 mm. Then, the regulating blade 30 is spot-welded on a cold rolled bracket 22 in place of the housing. The angle $\phi$ and the regulating angle $\theta^2$ are set in the above ranges.

The toner (not illustrated) used in the test is a polyester based powder toner having a diameter of 8 vm, the developing toner 23 is made of Nitrilo Butadiane rubber, and the supplying roller 25 is made of Nylon pelt brush.

TABLE 1

| Sample No. | $\phi$ [°] | $\theta_2$ [°] | F [gf/cm] | M/A [mg/cm$^2$] | Q/M [μC/g] |
|---|---|---|---|---|---|
| #1 | 20 | 20 | 24 | 0.83 | −5 |
| #2 | 20 | 30 | 26 | 0.80 | −5 |
| #3 | 20 | 40 | 28 | 0.78 | −5 |
| #4 | 20 | 50 | 29 | 0.75 | −5 |
| #5 | 20 | 60 | 29 | 0.74 | −6 |
| #6 | 20 | 70 | 30 | 0.73 | −7 |
| #7 | 20 | 80 | 30 | 0.71 | −8 |
| #8 | 30 | 20 | 29 | 0.74 | −6 |
| #9 | 30 | 30 | 30 | 0.73 | −7 |
| #10 | 30 | 40 | 33 | 0.64 | −15 |
| #11 | 30 | 50 | 35 | 0.61 | −17 |
| #12 | 30 | 60 | 39 | 0.49 | −21 |
| #13 | 30 | 70 | 32 | 0.44 | −25 |
| #14 | 30 | 80 | 43 | 0.41 | −28 |
| #15 | 40 | 20 | 30 | 0.73 | −7 |
| #16 | 40 | 30 | 31 | 0.72 | −8 |
| #17 | 40 | 40 | 34 | 0.63 | −16 |
| #18 | 40 | 50 | 36 | 0.60 | −18 |

TABLE 1-continued

| Sample No. | $\phi$ [°] | $\theta_2$ [°] | F [gf/cm] | M/A [mg/cm$^2$] | Q/M [μC/g] |
|---|---|---|---|---|---|
| #19 | 40 | 60 | 38 | 0.48 | −22 |
| #20 | 40 | 70 | 41 | 0.43 | −26 |
| #21 | 40 | 80 | 44 | 0.40 | −29 |
| #22 | 60 | 20 | 31 | 0.72 | −8 |
| #23 | 60 | 30 | 31.5 | 0.71 | −9 |
| #24 | 60 | 40 | 33 | 0.62 | −17 |
| #25 | 60 | 50 | 34 | 0.59 | −19 |
| #26 | 60 | 60 | 38 | 0.47 | −23 |
| #27 | 60 | 70 | 42 | 0.42 | −27 |
| #28 | 60 | 80 | 45 | 0.39 | −30 |
| #29 | 80 | 20 | 32 | 0.76 | −7 |
| #30 | 80 | 30 | 34 | 0.72 | −9 |
| #31 | 80 | 40 | 35 | 0.60 | −19 |
| #32 | 80 | 50 | 39 | 0.57 | −21 |
| #33 | 80 | 60 | 42 | 0.45 | −25 |
| #34 | 80 | 70 | 44 | 0.40 | −29 |
| #35 | 80 | 80 | 46 | 0.37 | −32 |
| #36 | 90 | 20 | 35 | 0.75 | −6 |
| #37 | 90 | 30 | 36 | 0.73 | −8 |
| #38 | 90 | 40 | 38 | 0.59 | −20 |
| #39 | 90 | 50 | 42 | 0.56 | −22 |
| #40 | 90 | 60 | 44 | 0.45 | −25 |
| #41 | 90 | 70 | 46 | 0.39 | −30 |
| #42 | 90 | 80 | 47 | 0.36 | −33 |
| #43 | 100 | 20 | 38 | 0.46 | −24 |
| #44 | 100 | 30 | 39 | 0.43 | −27 |
| #45 | 100 | 40 | 41 | 0.38 | −31 |
| #46 | 100 | 50 | 43 | 0.35 | −34 |
| #47 | 100 | 60 | 46 | 0.32 | −35 |
| #48 | 100 | 70 | 48 | 0.30 | −36 |
| #49 | 100 | 80 | 49 | 0.28 | −38 |

Table 1 illustrates values for the regulating angle $\theta_2$ and the angle $\phi$ where the toner weight per unit area (M/A), meaning the thickness of the toner layer formed on the surface of the developing roller, is about 0.45 to 0.7 mg/cm$^2$ and where the charging amount per unit toner weight (Q/M) satisfies the range of −10 to −23 μC/g, which are values for the regulating angle $\theta_2$ and the angle $\phi$ in the ranges of conditions 1 and 2, respectively.

M/A values between about 0.45 to 0.7 mg/cm$^2$ are selected because they represent a conversion of the toner layer L formed to have a thickness of about 1.3 to 2 times larger than a diameter of a toner particle on the developing roller 23 when a commercialized non-magnetic one component developer is used. If the M/A value deviates from its upper limit value (0.7 mg/cm$^2$), the Q/M value is lowered. Accordingly, in this case, it is difficult to control transfer of the toner from the developing roller to the photosensitive medium and transferring the toner image from the photosensitive medium to a printing medium or an intermediate transfer medium.

Also, quality of the image is deteriorated due to a background phenomenon where the toner moves beyond the image on the printing medium.

If the M/A value deviates from its lower limit value (0.45 mg/cm$^2$), the Q/M value is raised.

Accordingly, in this case an electric discharge can easily occur at a developing gap between the developing roller and the photosensitive media if a non-contact developing type developer is used where there is a developing value between the photosensitive medium and the developing roller. Therefore, since an electric field, which is less than that at the electric discharge, should be generated, the electric field becomes weak and a sufficient number of the toner particles may not be transferred to the photosensitive medium, so that an appropriate developing density cannot be obtained on the photosensitive medium. Such a phenomenon may be even worse when the developing unit is under a low temperature and low humidity. That is, as the Q/M value is raised under low temperature and low humidity conditions, it is even harder to obtain a target density of toner on the photosensitive medium.

Also, although the electric discharge does not occur between the developing roller and the photosensitive medium when a contact type developer, where the developing roller contacts with the photosensitive medium, is used, the M/A value becomes low. Therefore, a strong electric field should be applied to obtain a required density. In this case, even if the target density is obtained on the photosensitive medium under the strong electric field, the electric discharge is generated. Accordingly, the sufficient density cannot be obtained from the image transferred onto the printing medium.

Therefore, by disposing the regulating blade and the supplying roller to satisfy conditions 1 and 2, as in the developing unit according to the exemplary embodiment of the present general inventive concept illustrated in FIG. 2, the M/A value may be maintained in the range of about 0.45 to 0.7 mg/cm$^2$ and the Q/M value may be maintained in the range of about −10 to −23 μC/g. Also, by using the regulating blade having a double bending structure, the height of the housing may be lowered while satisfying the regulating angle of condition 1.

While only one developing unit is described as an example of the present general inventive concept in the above embodiment, the present general inventive concept is not limited thereto, and a plurality of the developing units can be used in a multi-path type image forming apparatus according to the present general inventive concept.

Figure 5:
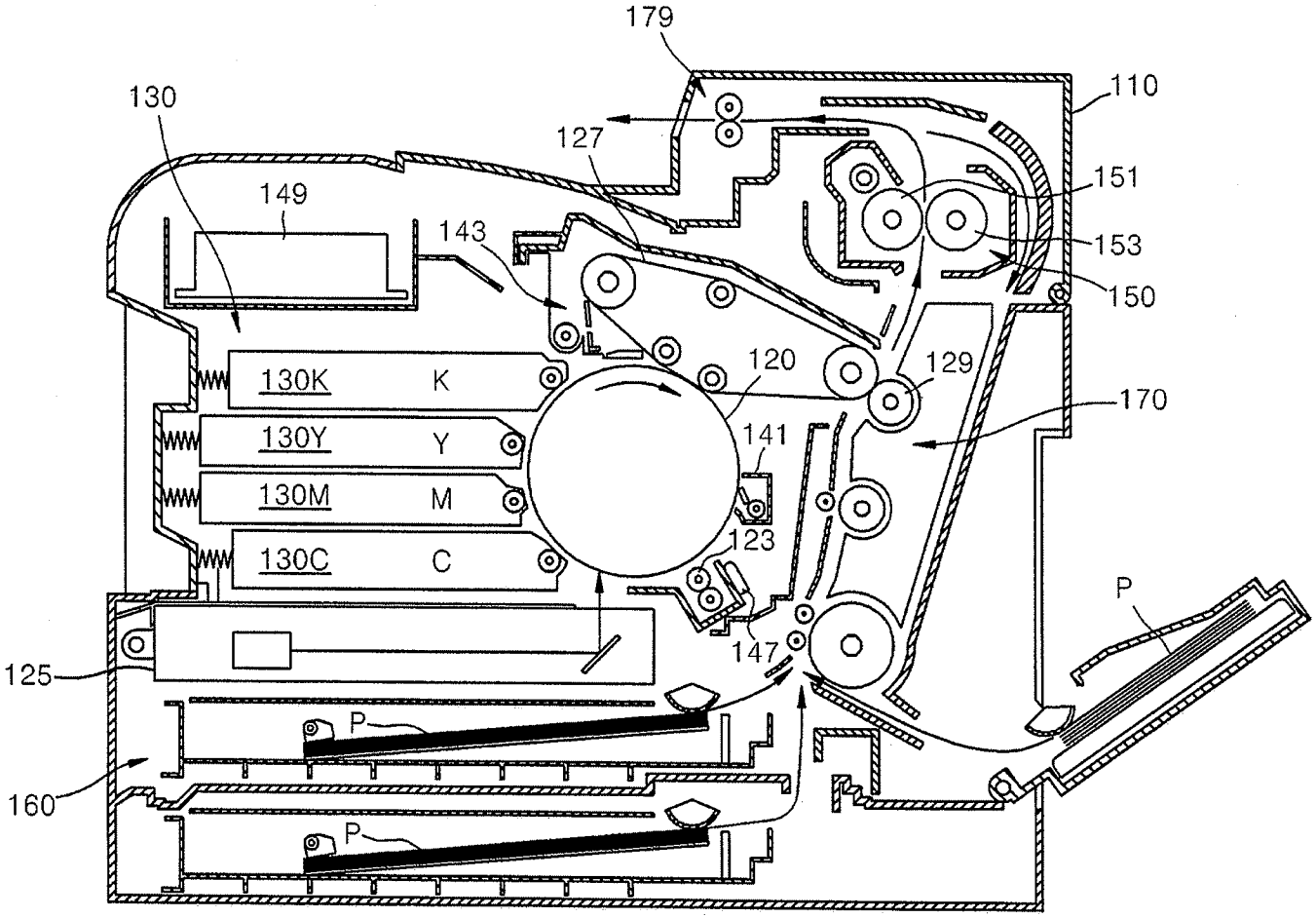
FIG. 5 is a sectional view schematically illustrating an electrophotographic image forming apparatus according to an exemplary embodiment of the present general inventive concept.

FIG. 5 is a sectional view schematically illustrating an electrophotographic image forming apparatus according to an exemplary embodiment of the present general inventive concept.

As illustrated in FIG. 5, the electrophotographic image forming apparatus may include a cabinet 110, a photosenstive medium 120 provided in the cabinet 110, a light scanning unit 125, a transfer unit 127, a developing unit 130, and a fixing unit 150.

The photosensitive medium 120 can be charged by a charging roller 123 to form an electrostatic latent image thereon by being exposed to a beam scanned by the light scanning unit 125. As illustrated in FIG. 5, the photosensitive medium 120 may include a metallic drum of a cylinder shape having a photoconductive layer formed on an outer circumference of the metallic drum.

The charging roller 123 can be an electric charger to charge the photosensitive medium 120 to a uniform electric potential. The charging roller 123 supplies an electric charge while rotating in contact or in non-contact with the photosensitive medium 120, thus enabling the photoconductive layer of the photosensitive medium 120 to have a uniform electric potential. Alternatively, a corona electric charger (not illustrated) may be used in place of the charging roller 123.

The light scanning unit 125 can be provided at a lower side of the photosensitive medium 120, and scans a light to the photosensitive medium 120 charged to the uniform electric potential to form the electrostatic latent image corresponding to image information.

The developing unit 130 may include first to fourth developing units 130C, 130M, 130Y, and 130K which can be divided by color. Each of the first to the fourth developing units 130C, 130M, 130Y, and 130K may contain a toner of a solid powder state having a color of cyan, magenta, yellow, and black, respectively. Each of the first to the fourth developing units 130C, 130M, 130Y and 130K may include a developing roller 135 respectively to supply the photosensitive medium 120 with the toner and to form the toner image for the electrostatic latent image formed on the photosensitive medium 120. In this case, a developing gap of about tens to hundreds microns can be formed between the developing roller 135 and the photosensitive medium 120, thus enabling non-contact developing of the latent image. When the developing is performed on the photosensitive medium 120 through the first to the fourth developing units 130C, 130M, 130Y, and 130K, only one developing roller 135 of the developing unit corresponding to one color may contribute to the developing for each rotation of the photosensitive medium 120.

Each developing unit 130 may include a housing, a developing roller, a supplying roller and a regulating blade (not illustrated). The structure and the disposition of the regulating blade and the disposition of the supplying roller are determined to satisfy conditions 1 and 2. Therefore, when the first to the fourth developing units 130C, 130M, 130Y, and 130K are used as illustrated in FIG. 5, a height of the housing of the developing units may be controlled to be about 16 mm while a tip pressure of the regulating blade can be lowered by increasing a regulating angle. Therefore, the overall structure, including the photosensitive medium 120, may be compact. As the constitution of each developing unit 130 is similar as that of the developing unit according to the embodiment of the present general inventive concept which has been described with reference to FIG. 2, a detail description is omitted.

The transfer unit 127 receives the image developed on the photosensitive medium 120 and transfers the image to a printing medium P. The toner image of each color sequentially formed on the photosensitive medium 120 is transferred onto the transfer unit 127 and is superposed therebetween to form a color image.

The image forming apparatus may include first and second cleaning units 141 and 143, an erasing lamp 147, a power supplying device 149, and a feeding unit 160.

When the toner image is transferred to the transfer unit 127, the first cleaning unit 141 can remove a waste toner remaining on an outer circumferential surface of the photosensitive medium 120. The second cleaning unit 143 can remove the waste toner remaining on the transfer unit 127 after the image transferred to the transfer unit 127 is secondly transferred to the printing medium P.

Before charging, the erasing lamp 147 removes the electric charge remaining on the outer circumferential surface of the photosensitive medium 120. That is, the erasing lamp 147 can remove the electric charge remaining on the surface of the photosensitive medium 120 by emitting light of a predetermined intensity onto the outer circumferential surface of the photosensitive medium 120.

The power supply device 149 provides a developing bias power source, a developing prevention bias power source, first and second transfer bias power sources, and a charging bias power source. The developing bias power source serves to develop the toner from the first to fourth developing units 130C, 130M, 130Y, and 130K onto the photosensitive medium 120. The developing prevention bias power source serves to prevent the toner of the developing unit other than that contributing to the developing from being developed onto the photosensitive medium 120.

The first transfer bias power source is used to transfer the toner image from the photosensitive medium 120 to the transfer unit 127, and the second transfer bias power source is used to transfer the toner image from the transfer unit 127 to the printing medium P. The charging bias power source is a power source applied to the charging roller 123.

The fixing unit 150 serves to fix the toner image transferred to the printing medium P, and may include a pair of fixing rollers 151 and 153 which rotate in contact therebetween with a predetermined pressure. A heating source (not illustrated) can be provided to at least one of the pair of the fixing rollers 151 and 153. Accordingly, when the printing medium P having the transferred image passes through the fixing unit 150, the toner image is fused on the printing medium P by heat and pressure thus completing the image printing process.

The feeding unit 160 can provide a space to load the printing medium P. The printing medium P supplied through the feeding unit 160 can be conveyed through a conveying unit 170 to a path between the transfer unit 127 and a pressing roller 129. The printing medium P having the printed image is discharged to an outside through a discharging roller 179.

According to the developing unit as described above, decreasing the tip pressure below 40 gf/cm can prevent an excessive stress from being applied to the toner and prevent the image developed on the photosensitive medium from being deteriorated. Also, the developing roller is prevented from being worn by a high tip pressure, thus extending its life time.

Also, by forming the regulating blade into a double bending structure, the regulating angle $\theta_2$ may be increased without increasing the height of the housing, and the disposition angle between the regulating blade and the supplying roller may be optimized. Therefore, the required M/A and Q/M values may be maintained while the tip pressure is lowered, thus preventing a non-uniform toner layer and errors in developing and transferring of the image.

Also, the height of the developing unit may be controlled to be within about 16 mm, thus enabling the overall structure to be compact and a manufacturing cost to be reduced. Also, the disposition of the developing unit can be optimized thus improving printing quality.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing unit usable in an image forming apparatus, the developing unit comprising:

a housing to hold a toner;

a developing roller disposed in the housing to supply the toner to a photosensitive body of the image forming apparatus;

a supplying roller disposed in the housing to supply toner to the developing roller; and a double-bent regulating blade connected to the housing to regulate a toner layer formed on the developing roller, wherein the double-bent regulating blade includes a coupling part to couple with the housing, and a free end part to contact the developing roller, the free end part having a first bending part and a second bending part, the first part which is bending arcuately between the housing and the second bending part, and the second bending part which is bending arcuately between the first bending part and the developing roller.

2. The developing unit of claim 1, wherein the first bending part bends in a rotation direction opposite to a rotation direction in which the second bending part bends.

3. The developing unit of claim 1, wherein the free end part is bent and forms an angle $\theta_3$ of less than 180° between the first bending part to connect to the coupling part and the second bending part to contact the developing roller.

4. The developing unit of claim 3, wherein the second bending part comprises:

a tip disposed at an end of the second bending part to contact the developing roller, wherein the tip is provided in a direction favorable to a rotational direction of the developing roller such that the tip trails a rotation of the developing roller and regulates the toner layer formed on the developing roller.

5. The developing unit of claim 3, wherein the double-bent regulating blade is disposed such that the coupling part is at a position higher than a center of the developing roller.

6. The developing unit of claim 1, wherein an angle $\phi$ between a line connecting a contact point of the double-bent regulating blade and a center of the developing roller and a line connecting the center of the developing rover and a center of the supplying roller is about $30° \leqq \phi \leqq 90°$.

7. The developing unit of claim 1, wherein a height of the housing is about 16 mm or less.

8. The developing unit of claim 1, wherein the double-bent regulating blade is disposed between the developing roller and the housing, and comprises a fixed end coupled to the housing, a tip contacting the developing roller, the first bending part extended from the fixed end, and the second bending part extended and bent between the first bending part and the tip.

9. The developing unit of claim 8, wherein the second bending part forms an angle greater than 40° with a tangential line of the developing roller at a contact position between the tip and the developing roller.

10. The developing unit of claim 8, wherein the first bending part is arcuately bent from the fixed end in a first rotation direction and the second bending part is arcuately bent from the first bending part in a second rotation direction.

11. The developing unit of claim 10, wherein the tip comprises a distal end bent from the second bending part in the first rotation direction.

12. An image forming apparatus, comprising:

a photosensitive medium to form an electrostatic latent image by being charged and exposed to a light;

at least one developing unit to supply a toner to the photosensitive medium;

a transfer unit to transfer the image formed on the photosensitive unit onto a printing medium; and a fixing unit to fix the image transferred onto the printing medium, wherein the at least one developing unit comprises:

a housing to hold a toner, a developing roller disposed in the housing to supply the toner to a photosensitive body of the image forming apparatus, a supplying roller disposed in the housing to supply toner to the developing roller, and a double-bent regulating blade connected to the housing to regulate a toner layer formed on the developing roller, wherein the double-bent regulating blade includes a coupling part to couple with the housing, and a free end part to contact the developing roller, the free end part having a first bending part and a second bending part, the first bending part which is bending arcuately between the housing and the second bending part, and the second bending part which is bending arcuately between the first bending part and the developing roller.

13. The image forming apparatus of claim 12, wherein the first bending part bends in a rotation direction in which the second bending part bends.

14. The image forming apparatus of claim 12, wherein the free end part is bent and forms an angle $\theta_3$ of less than 180° between the first bending part to connect to the coupling part and the second bending part to contact the developing roller.

15. The image forming apparatus of claim 14, wherein the second bending part comprises:

a tip disposed at an end of the second bending part to contact the developing roller, wherein the tip is provided in a direction favorable to a rotational direction of the developing roller such that the tip trails a rotation of the developing roller and regulates the toner layer formed on the developing roller.

16. The image forming apparatus of claim 14, wherein the double-bent regulating blade is disposed such that the coupling part is at a position higher than a center of the developing roller.

17. The image forming apparatus of claim 12, wherein an angle $\phi$ between a line connecting a contact point of the double-bent regulating blade and a center of the developing rover and a line connecting the center of the developing roller and a center of the supplying roller is about $30° \leqq \phi \leqq 90°$.

18. The image forming apparatus of claim 12, wherein the at least one developing unit comprises at least one developing unit for each of a plurality of predetermined colors, and a height of the housing of each developing unit is about 16 mm or less.

19. The image forming apparatus of claim 12, wherein the double-bent regulating blade is disposed between the developing roller and the housing, and comprises a fixed end coupled to the housing, a tip contacting the developing roller, the first bending part extended from the fixed end, and the second bending part extended and bent between the first bending part and the tip.

20. The image forming apparatus of claim 19, wherein the second bending part forms an angle greater than 40° with a tangential line of the developing roller at a contact position between the tip and the developing roller.

21. The image forming apparatus of claim 19, wherein the first bending part is arcuately bent from the fixed end in a first rotation direction and the second bending part is arcuately bent from the first bending part in a second rotation direction.

22. The image forming apparatus of claim 21, wherein the tip comprises a distal end bent from the second bending part in the first rotation direction.

* * * * *